US011541972B2

(12) United States Patent
Swiatek

(10) Patent No.: US 11,541,972 B2
(45) Date of Patent: Jan. 3, 2023

(54) REEL SYSTEM

(71) Applicant: Ryan Swiatek, Wichita Falls, TX (US)

(72) Inventor: Ryan Swiatek, Wichita Falls, TX (US)

( * ) Notice: Subject to any disclaimer, the term of this patent is extended or adjusted under 35 U.S.C. 154(b) by 517 days.

(21) Appl. No.: 16/681,817

(22) Filed: Nov. 12, 2019

(65) Prior Publication Data

US 2020/0148313 A1 May 14, 2020

Related U.S. Application Data

(60) Provisional application No. 62/758,306, filed on Nov. 9, 2018.

(51) Int. Cl.

| | |
|---|---|
| ***B63B 34/60*** | (2020.01) |
| ***B65H 75/34*** | (2006.01) |
| ***B63B 34/67*** | (2020.01) |

(52) U.S. Cl.

CPC ..... *B63B 34/60* (2020.02); *B63B 34/67* (2020.02); *B65H 75/34* (2013.01)

(58) Field of Classification Search

CPC ..... B63B 34/60; B63B 34/67; B65H 75/34

USPC ..... 114/253, 254

See application file for complete search history.

(56) References Cited

U.S. PATENT DOCUMENTS

| | | | | |
|---|---|---|---|---|
| 3,964,425 A * | 6/1976 | Septor, Sr. | ..... | B65H 75/425 242/390.8 |
| 10,640,181 B1 * | 5/2020 | Decker | ..... | B63B 21/56 |

* cited by examiner

*Primary Examiner* — Daniel V Venne

(74) *Attorney, Agent, or Firm* — Shannon Warren

(57) ABSTRACT

A reel system for managing a surf rope on a boat. The reel system comprises a retraction assembly, a rod and the surf rope. The boat comprises a cross bar, a stern, a port, one or more sides, a starboard, and a tower having a tower height. The surf rope comprises a rope height between the retraction assembly and a handle portion of the surf rope. The surf rope comprises a first end and a second end. The reel system comprises a system for positioning and managing the surf rope for a surfer. The reel system is configured to manage the surf rope by retracting and positioning the surf rope at one or more default rope positions when not in use and otherwise selectively allow the surf rope to rotate back for surfing. The one or more default rope positions comprise at least a first default rope position.

17 Claims, 14 Drawing Sheets

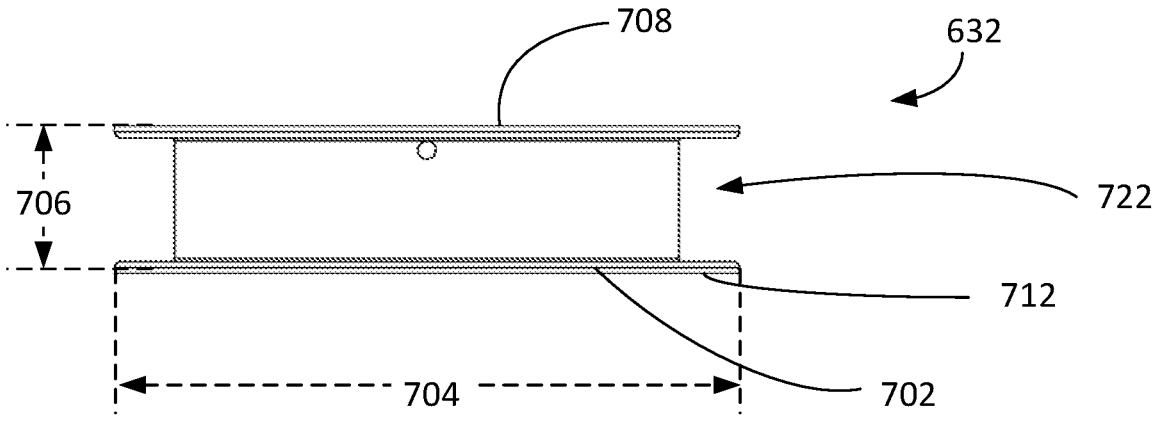
FIG. 7A
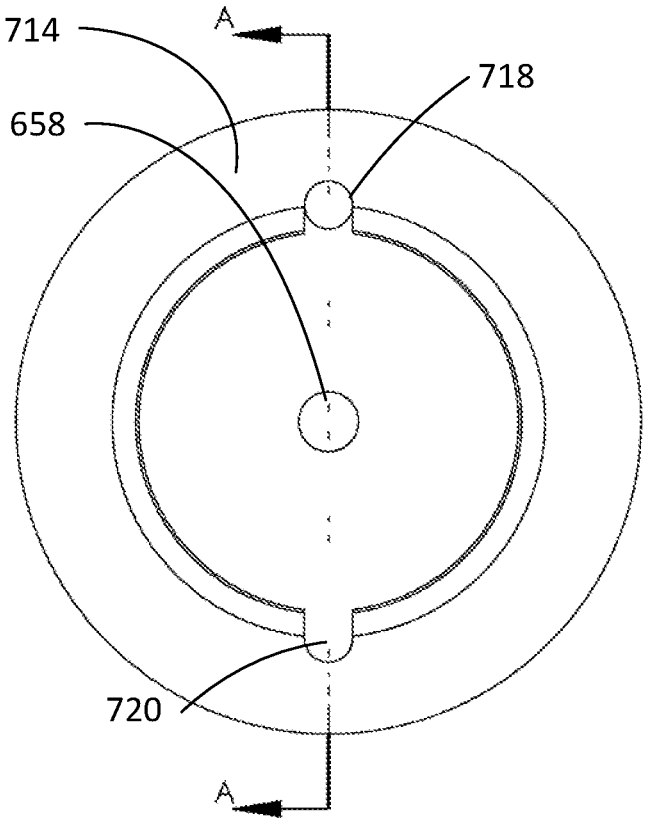
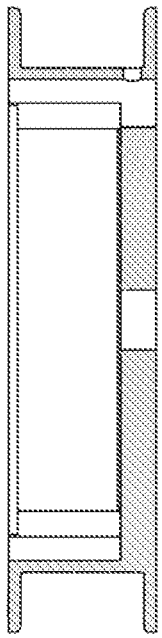
SECTION A-A
FIG. 7B
FIG. 7C

REEL SYSTEM

CROSS-REFERENCE TO RELATED APPLICATIONS

This application claims benefit to U.S. Patent Application No. 62/758,306 filed on Nov. 9, 2018.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant

BRIEF SUMMARY OF THE INVENTION

A reel system 100 for managing a surf rope 112 on a boat 102. Said reel system 100 comprises a retraction assembly 108, a rod 110 and said surf rope 112. Said boat 102 comprises a cross bar 106, a stern 114, a port 116*a*, one or more sides 116, a starboard 116*b*, and a tower 104 having a tower height 118. Said surf rope 112 comprises a rope height 120 between said retraction assembly 108 and a handle portion 400 of said surf rope 112. Said surf rope 112 comprises a first end 416 and a second end 418. Said reel system 100 comprises a system for positioning and managing said surf rope 112 for a surfer 304. Said reel system 100 is configured to manage said surf rope 112 by retracting and positioning said surf rope 112 at one or more default rope positions 202 when not in use and otherwise selectively allow said surf rope 112 to rotate back for surfing and skiing purposes. Said one or more default rope positions 202 comprise at least a first default rope position 202*a*. Said boat 102 comprises a direction of travel 204. Said reel system 100 rotates a second end 414 and said handle portion 400 along with said rod 110 along a rotary path 210 at a rotation radius 206. when said surfer 304 releases said surf rope 112, said reel system 100 is configured to rotate to said one or more default rope positions 202. Said reel system 100 comprises a retraction force 302. A length 420 of said rod 110 is long enough to clear of a rear passenger area 214. Said rear passenger area 214 comprises portions of said boat 102 between said tower 104 and said stern 114. Said reel system 100, therefore, is configured to selectively hold said surf rope 112 out of harm's way for a passenger 216. A mounting assembly 502 comprises a mounting plate 504 and a swivel base 506, and a rider plate 656. A top housing cavity 638 and a lower housing cavity 642 are configured to hold portions of a spring 628, and a pulley 632. Said spring 628 provides said retraction force 302 to pull said surf rope 112 around said pulley 632. Said spring 628 is configured to default to pulling said surf rope 112 back into said retraction assembly 108, portions of said surf rope 112 is configured to selectively wrap around said pulley 632 in a spool cradle 608. Said rod 110 comprises a channel 806 comprising a hollow channel between a first end 412 and said second end 414, and a length 808.

Said reel system 100 for managing said surf rope 112 on said boat 102. Said reel system 100 comprises said retraction assembly 108, said rod 110 and said surf rope 112. Said boat 102 comprises said cross bar 106, said stern 114, said port 116*a*, said one or more sides 116, said starboard 116*b*, and said tower 104 having said tower height 118. Said surf rope 112 comprises said rope height 120 between said retraction assembly 108 and said handle portion 400 of said surf rope 112. Said surf rope 112 comprises said first end 416 and said second end 418. Said reel system 100 comprises a system for positioning and managing said surf rope 112 for said surfer 304. Said reel system 100 is configured to manage said surf rope 112 by retracting and positioning said surf rope 112 at said one or more default rope positions 202 when not in use and otherwise selectively allow said surf rope 112 to rotate back for surfing and skiing purposes. Said one or more default rope positions 202 comprise at least said first default rope position 202*a*. Said boat 102 comprises said direction of travel 204. Said reel system 100 rotates said second end 414 and said handle portion 400 along with said rod 110 along said rotary path 210 at said rotation radius 206, when said surfer 304 releases said surf rope 112, said reel system 100 is configured to rotate to said one or more default rope positions 202.

BRIEF DESCRIPTION OF THE SEVERAL VIEWS OF THE DRAWING

FIGS. 7A, 7B and 7C illustrate an elevated front view, top view and cross section view of a pulley 632.

DETAILED DESCRIPTION OF THE INVENTION

Figure 1A:
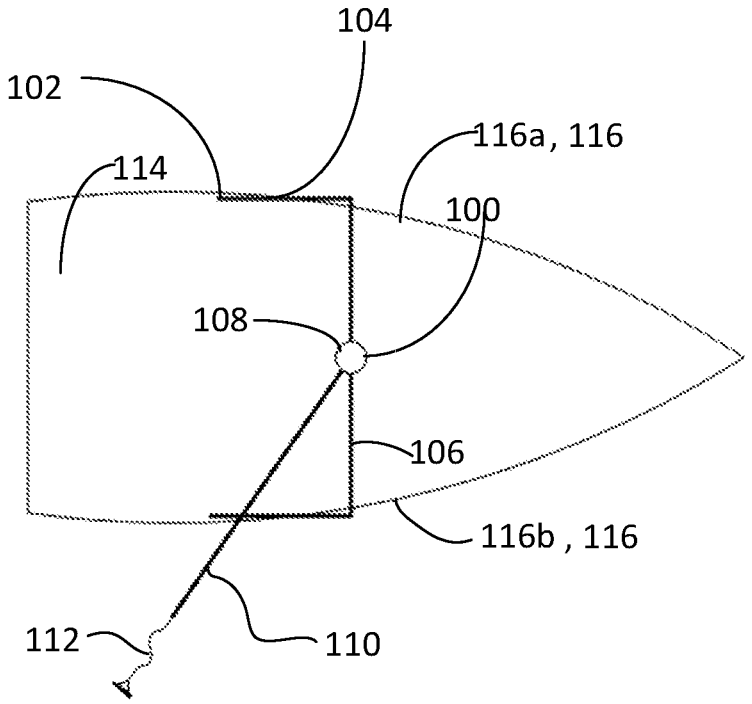
FIGS. 1A and 1B illustrate an elevated top and front side view of a boat 102 with a reel system 100.
Figure 1B:
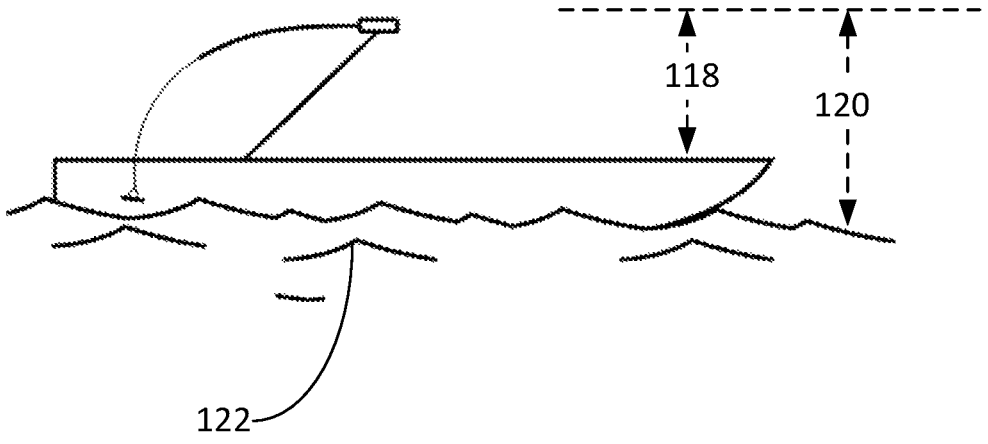

FIGS. 1A and 1B illustrate an elevated top and front side view of a boat 102 with a reel system 100.

In one embodiment, said reel system 100 can comprise a retraction assembly 108, a rod 110 and a surf rope 112.

In one embodiment, said boat 102 can comprise a cross bar 106, a stern 114, a port 116*a*, one or more sides 116, a starboard 116*b*.

In one embodiment, a tower 104 can comprise a tower height 118.

In one embodiment, said surf rope 112 can comprise a rope height 120 between said retraction assembly 108 and a handle portion 400 of said surf rope 112.

Depending on a position of said handle portion 400 of said surf rope 112 and a water 122, said tower height 118 and said rope height 120 can vary.

Said boat 102 can comprise a ski or wake surfing boat, as is known in the art.

In one embodiment, said reel system 100 can comprise a system for positioning and managing said surf rope 112 for wake surfers.

Said reel system 100 can manage said surf rope 112 by retracting and positioning said surf rope 112 at said rope height 120 when not in use and otherwise selectively allow said surf rope 112 to rotate back for surfing and skiing purposes.

Figure 2:
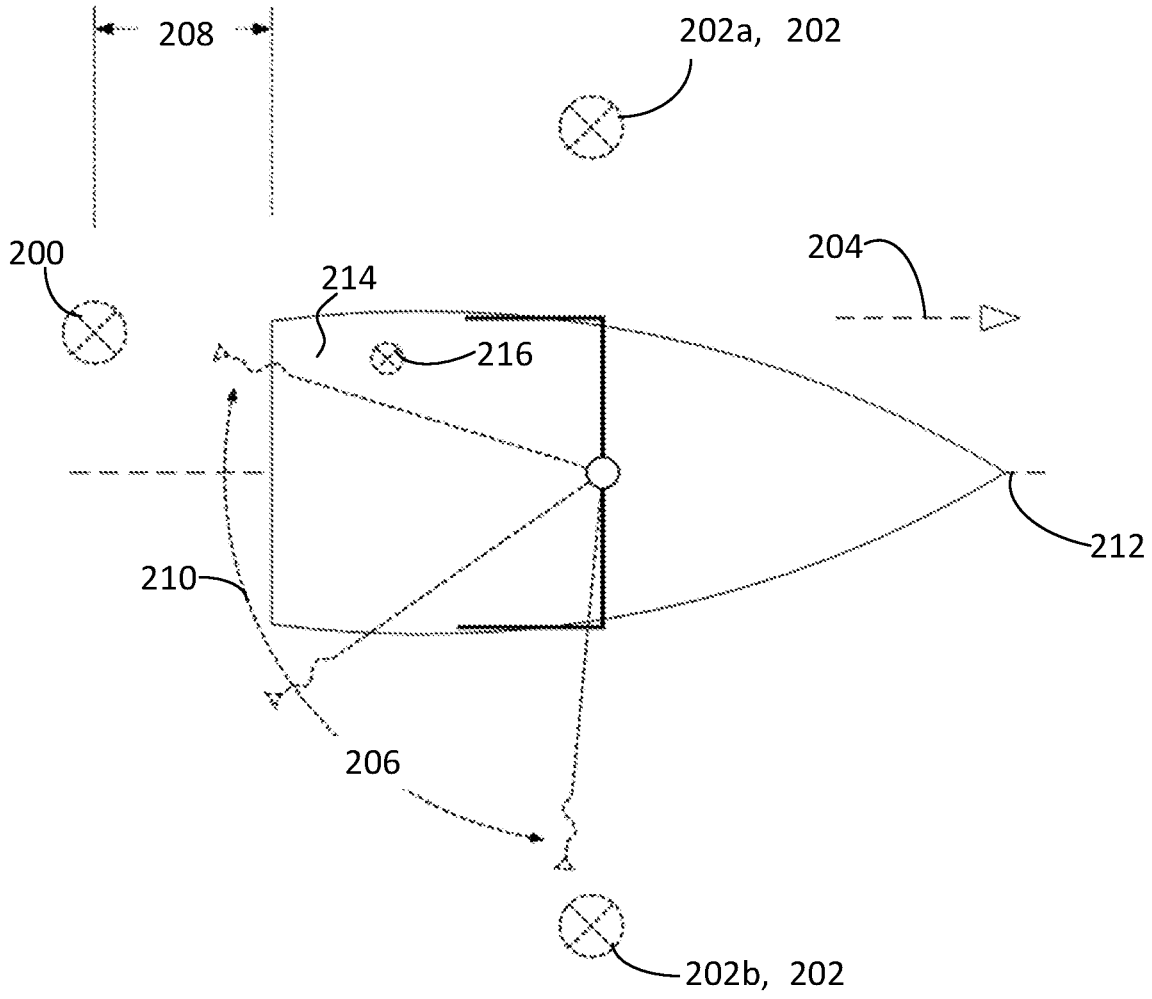
FIG. 2 illustrates an elevated top side view of said boat 102.

FIG. 2 illustrates an elevated top side view of said boat 102.

In one embodiment, one or more default rope positions 202 can comprise a direction of travel 204 and a rotation radius 206.

In one embodiment, said reel system 100 can comprise a first default rope position 202*a*, a second default rope position 202*b*, and a rotary path 210.

In one embodiment, said boat 102 can comprise a rear passenger area 214 for a passenger 216, as illustrated.

In the prior art, said surf rope 112 must be managed by a surfer 304 and said passenger 216 of said boat 102. Often, said surfer 304 will ball up portions of said surf rope 112 and throw it at said stern 114 of said boat 102. This approach means that said surf rope 112 can become a danger to said passenger 216 and said surfer 304 alike if said surf rope 112 does not properly land in said boat 102.

Additionally, said surf rope 112 can become soaked in said water 122 and be damaged.

A distance back 208 can be different distances for different surfers. For example, a gifted surfer might surf 20 feet back from said stern 114. Said distance back 208 can comprise a distance from said stern 114 to a surf position 200.

Figure 3:
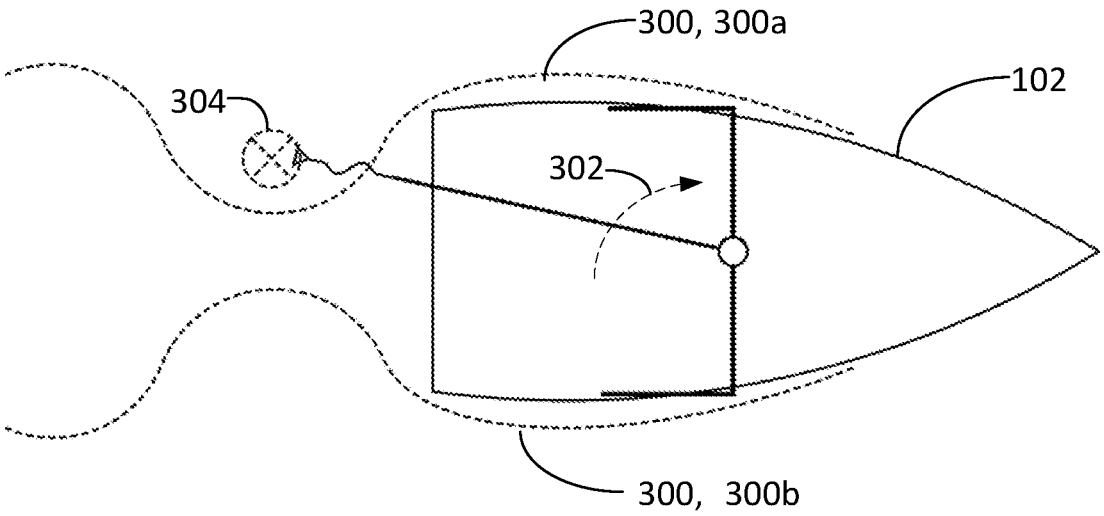
FIG. 3 illustrates an elevated top side view of said boat 102.

FIG. 3 illustrates an elevated top side view of said boat 102.

In one embodiment, a side waves 300 can comprise said side waves 300 and a first wave 300*a*.

In one embodiment, said boat 102 can comprise said water 122 and a second wave 300*b*.

As is known in the art, said side waves 300 pull said surfer 304 along. When said surfer 304 releases said surf rope 112, said reel system 100 can be configured to rotate to said one or more default rope positions 202. In FIG. 3, said reel system 100 is configured to rotate said reel system 100 back to said first default rope position 202*a*.

In one embodiment, a retraction force 302 can comprise six to ten pounds of spring force. In one embodiment, said retraction force 302 can comprise eight pounds of force.

Figure 4A:
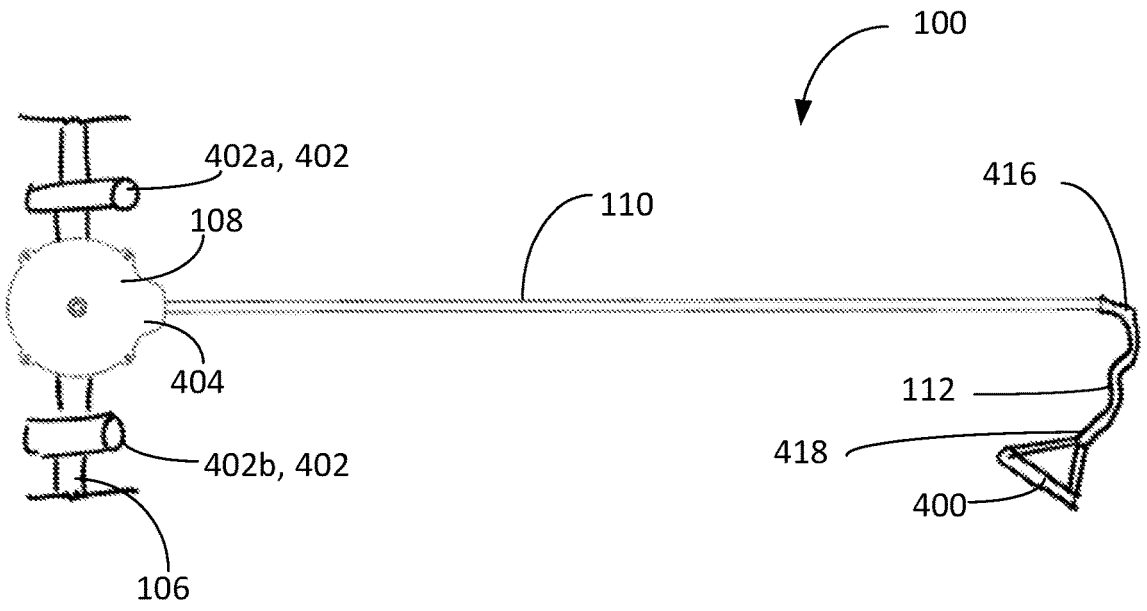
FIGS. 4A and 4B illustrate an elevated top side and front side view of said reel system 100.
Figure 4B:
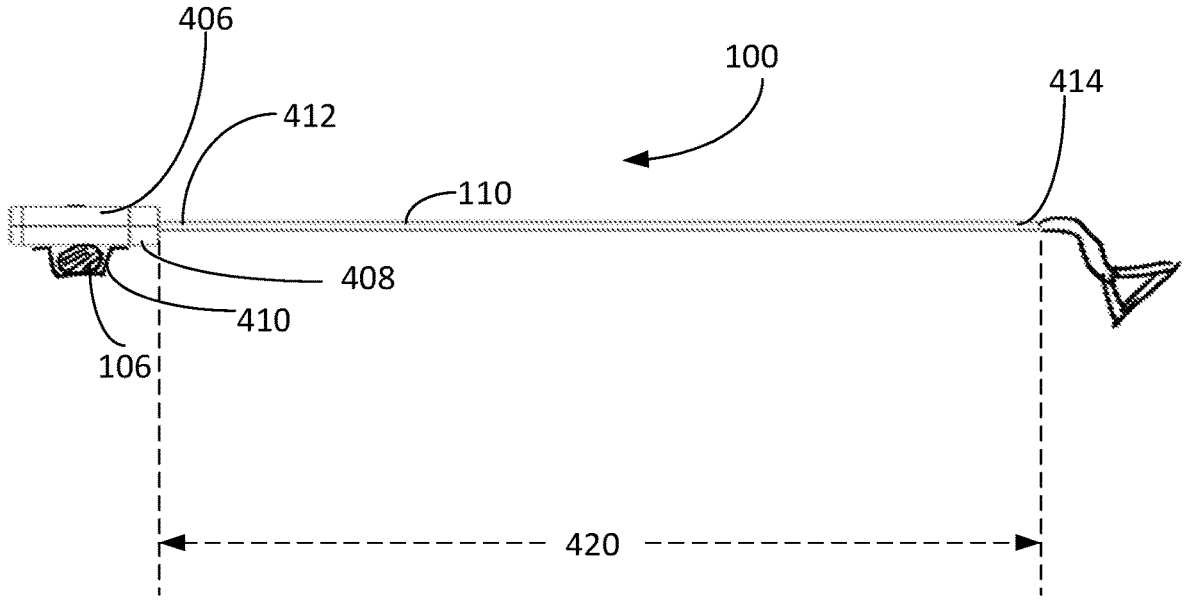

FIGS. 4A and 4B illustrate an elevated top side and front side view of said reel system 100.

In one embodiment, one or more bumpers 402 can comprise a first bumper 402*a* and a second bumper 402*b*.

In one embodiment, said reel system 100 can comprise said retraction force 302 and said handle portion 400.

In one embodiment, said retraction assembly 108 can comprise said one or more bumpers 402, a front portion 404, a top housing 406 and a bottom housing 408.

In one embodiment, said rod 110 can comprise a lower bracket 410, a first end 412 and a second end 418.

In one embodiment, said surf rope 112 can comprise a second end 414 and a first end 416.

In one embodiment, said one or more bumpers 402 can prevent said reel system 100 from rotating beyond a point being substantially perpendicular from said direction of travel 204 and likewise to position said handle portion 400 over said one or more default rope positions 202.

A length 420 can be long enough to clear of said rear passenger area 214 (portions of said boat 102 between said tower 104 and said stern 114). said reel system 100, therefore, is configured to selectively hold said surf rope 112 out of harm's way for said passenger 216.

Figure 5:
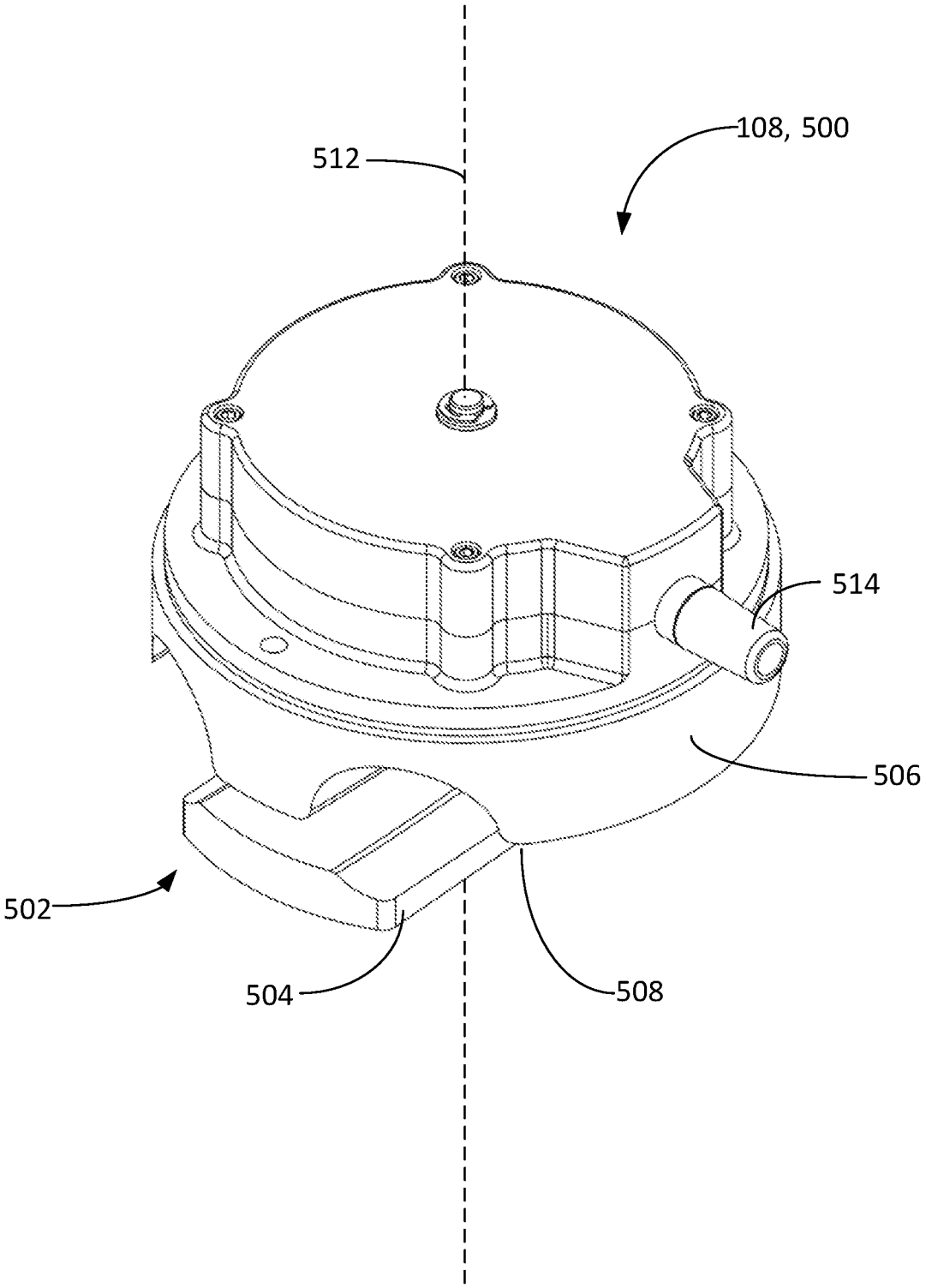
FIG. 5 illustrates a perspective overview of said reel system 100 in an assembled configuration 500.

FIG. 5 illustrates a perspective overview of said reel system 100 in an assembled configuration 500.

In one embodiment, said retraction assembly 108 can comprise a mounting assembly 502. Said mounting assembly 502 can comprise a mounting plate 504, a swivel base 506, and a plurality of mounting fasteners 508. In one embodiment, said mounting plate 504 and said swivel base 506 can squeeze around said cross bar 106 to hold said reel system 100 to said tower 104. In one embodiment, a different mounting equipment can be used and configured according to a various tower designs, as is known in the art.

Said retraction assembly 108 can further comprise a rope nozzle 514, a vertical axis 512. Said rope nozzle 514 can extend out from said vertical axis 512 and provide a passage from within said retraction assembly 108 for said surf rope 112 to slide in and out without snagging said surf rope 112. Said rope nozzle 514 can comprise a smooth machined part with a conical shape and a hollow central aperture.

Figure 6:
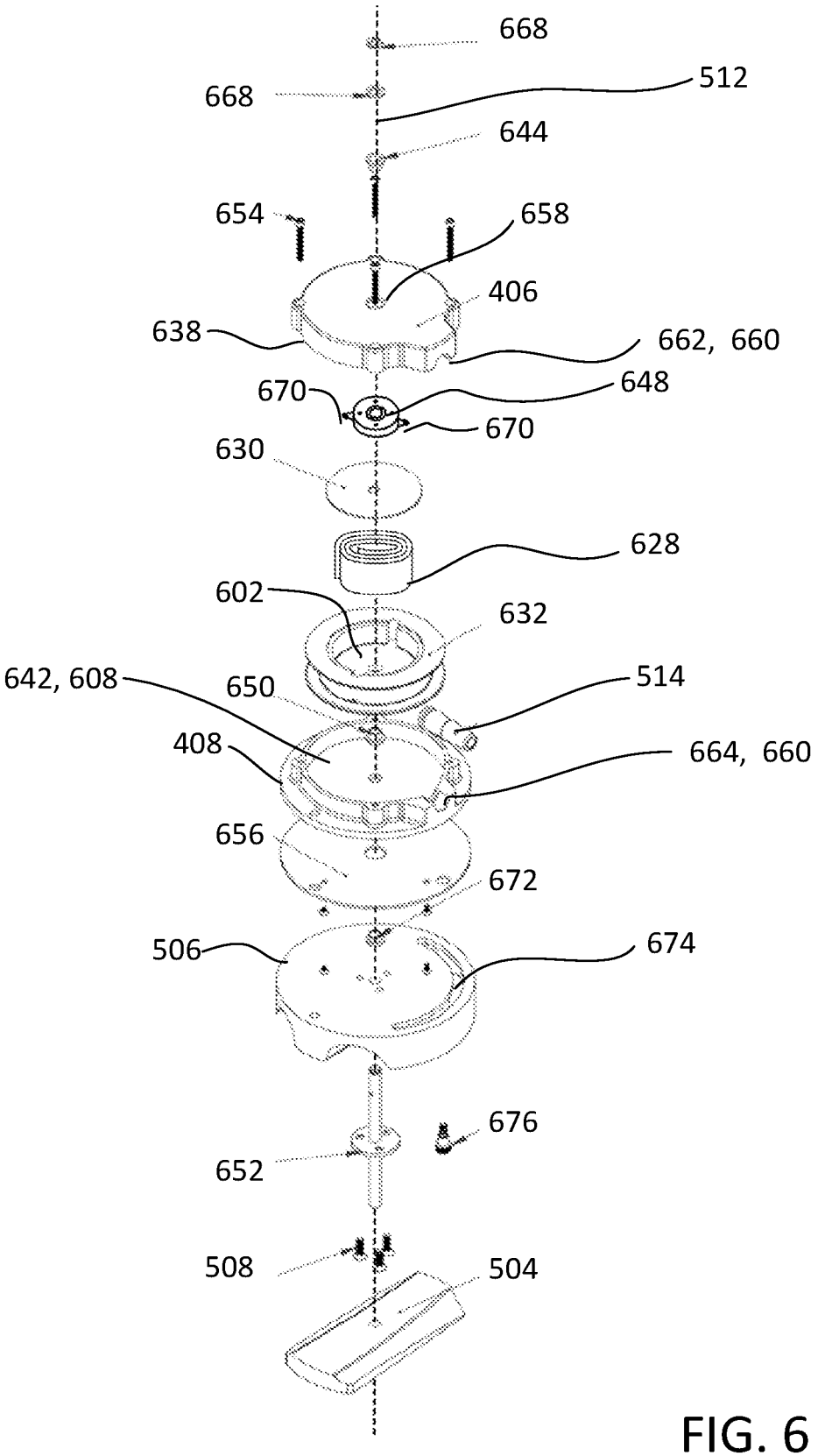
FIG. 6 illustrates a perspective bottom side and top side view of a top housing 406 exploded.

FIG. 6 illustrates a perspective bottom side and top side view of said top housing 406 exploded.

In one embodiment, said retraction assembly 108 can comprise an upper bushing 644, said top housing 406, a spring 628, a dampener 648, a pulley 632, said bottom housing 408, and said mounting assembly 502, a lower bushing 650, a pivot rod 652, a plurality of housing fasteners 654.

In one embodiment, said mounting assembly 502 can comprise said mounting plate 504 and said swivel base 506, and a rider plate 656.

In one embodiment, said top housing 406 and said bottom housing 408 can comprise a top housing cavity 638 and a lower housing cavity 642.

In one embodiment, said plurality of housing fasteners 654 can hold said top housing 406 and said bottom housing 408 together. In one embodiment, said top housing cavity 638 and said lower housing cavity 642 can hold portions of said spring 628, said pulley 632, said upper bushing 644, said dampener 648, said lower bushing 650 and said pivot rod 652.

In one embodiment, portions of said retraction assembly 108 can comprise a central aperture 658 to accommodate said pivot rod 652, as illustrated.

In one embodiment, said spring 628 can default to pulling said surf rope 112 back into said retraction assembly 108. Likewise, said spring 628 can default to rotating said handle portion 400 from said surf position 200 to said first default rope position 202*a*.

In one embodiment, said dampener 648 can slow said retraction force 302 between said retraction assembly 108, said pulley 632 and said pivot rod 652 to a desired force. In doing so, said retraction assembly 108 can retract and reset to said first default rope position 202*a* without danger to users of said reel system 100.

Said retraction assembly 108 can comprise a plurality of components configured to spool, release, and retract said surf rope 112 according to the design specification of this disclosure.

In one embodiment, portions of said surf rope 112 can selectively wrap around said pulley 632 in a spool cradle 608.

In one embodiment, a portion of said rod 110 can attach to said rope nozzle 514, which can be held within a portion of a nozzle aperture 660 which can comprise an upper nozzle aperture 662 and a lower nozzle aperture 664.

In one embodiment, a one or more washers and nuts 668 can fit on an upper end of said pivot rod 652.

In one embodiment, a portion of said pivot rod 652 slides through a portion of said dampener 648, and one or more dampener mounts 670 are attached to a portion of said retraction assembly 108 to slow relative movement between said rod 110 and said pivot rod 652.

In one embodiment, a dampener housing cavity can be provided to hold portions of said dampener 648 within said top housing cavity 638. These illustrations do not include said dampener housing cavity but the illustrations are understood to include a space sufficient to include portions of said dampener 648 within said top housing cavity 638.

In one embodiment, a portion of said lower housing cavity 642 can mount to a portion of said rider plate 656; a second lower bushing 672 can slide through said pivot rod 652; said swivel base 506 can comprise a rotary slot 674 to limit movement of said rod 110; said mounting assembly 502 can further comprise a set screw 676 configured to slide through a portion of said rotary slot 674 and into a portion of said rider plate 656.

FIGS. 7A, 7B and 7C illustrate an elevated front view, top view and cross section view of said pulley 632.

In one embodiment, said pulley 632 can comprise a spring slot 718, a rope slot 720, a lower flange 712, a top flange 714, a top surface 708, a height 706, a width 704, a bottom surface 702, and a rope spool 722.

Said pulley 632 can be configured to receive said spring 628 in a spool spring cavity 602.

In one embodiment, said spool cradle 608 can comprise a space between said top surface 708, said lower flange 712, and said top flange 714.

In one embodiment, a portion of said spring 628 can be held at one end in said spring slot 718 and at a second end to said pivot rod 652. Accordingly, said spring 628 is prevented from spinning with said pulley 632, as is known in the art.

In one embodiment, a rope aperture 724 can allow a portion of said surf rope 112 to pass through a pulley sidewall 726.

Figure 8A:
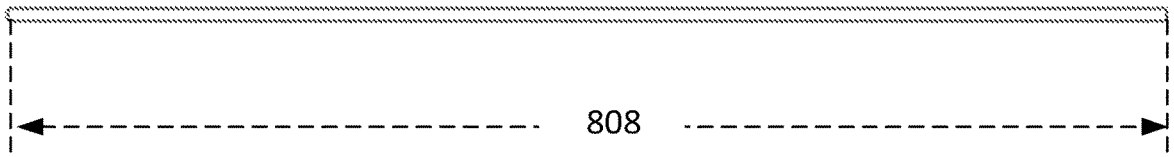
FIGS. 8A and 8B illustrate an elevated front side view and perspective overview of a rod 110.
Figure 8B:
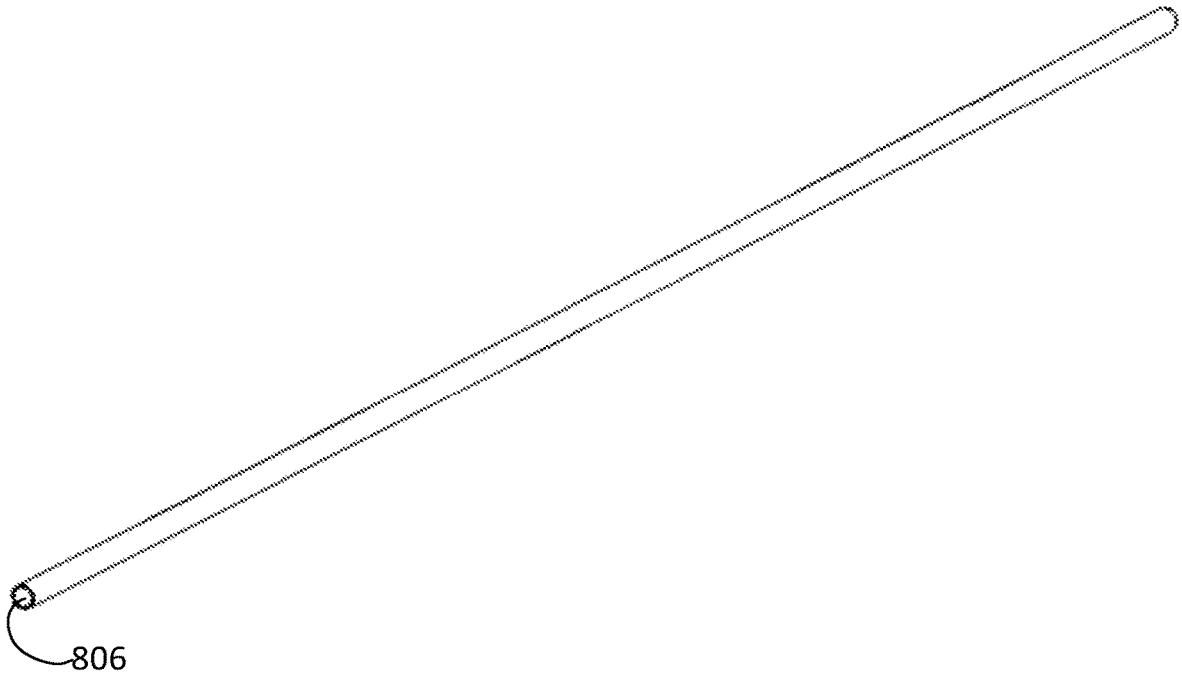

FIGS. 8A and 8B illustrate an elevated front side view and perspective overview of said rod 110.

In one embodiment, said rod 110 can comprise a channel 806 comprising a hollow channel between said first end 412 and said second end 414, and a length 808.

Figure 9A:
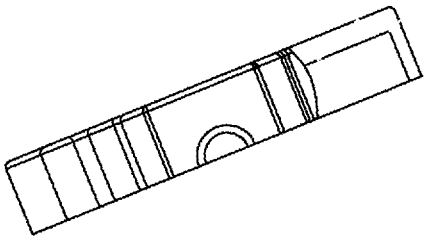
FIGS. 9A, 9B and 9C illustrate an elevated front side view, a top side view and a bottom side view of said top housing 406.
Figure 9B:
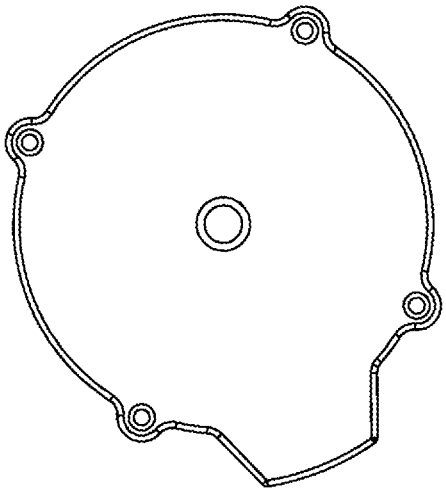
Figure 9C:
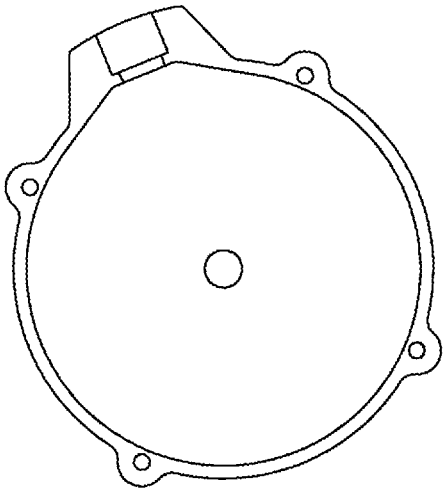

FIGS. 9A, 9B and 9C illustrate an elevated front side view, a top side view and a bottom side view of said top housing 406.

Said top housing 406 can comprise a plurality of fastener apertures 900.

In one embodiment, said top housing 406 can comprise a substantially circular shape.

Figure 10A:
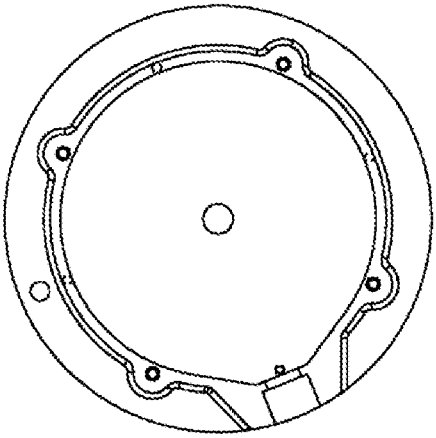
FIGS. 10A, 10B and 10C illustrate an elevated front side view, a top side view and a bottom side view of a bottom housing 408.
Figure 10B:
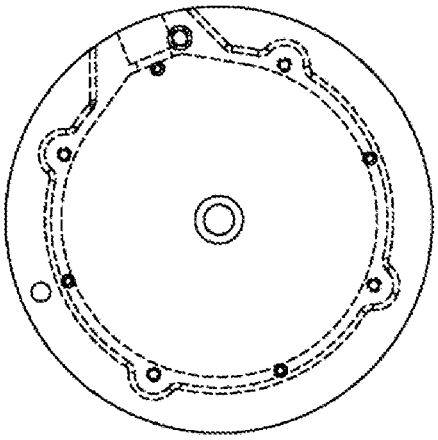
Figure 10C:
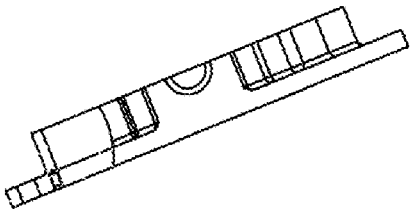

FIGS. 10A, 10B and 10C illustrate an elevated front side view, a top side view and a bottom side view of said bottom housing 408.

In one embodiment, said bottom housing 408 can comprise a height 1034, one or more lower aperture extensions 1026, a first lower aperture extension 1016*a*, a second lower aperture extension 1018*b*, a third lower aperture extension 1020*c*, a bottom surface 1204, a side wall 1014, a fourth lower aperture extension 1022*d*, and a center aperture 1202.

In one embodiment, said top housing 406 can be held to said bottom housing 408 with said plurality of fastener apertures 900. Said plurality of fastener apertures 900 can comprise threaded bolts. One or more fastener clasps 1008 can comprise nuts, washers, sockets, or other female threaded tools, as is known in the art.

In one embodiment, said top housing 406 can create a seal against said bottom housing 408.

Figure 11A:
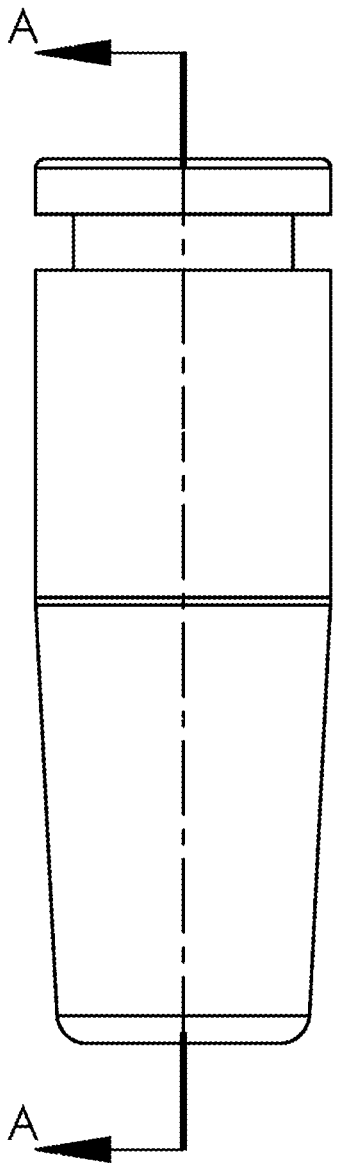
FIGS. 11A and 11B illustrate an elevated front side and cross section view of a rope nozzle 514.
Figure 11B:
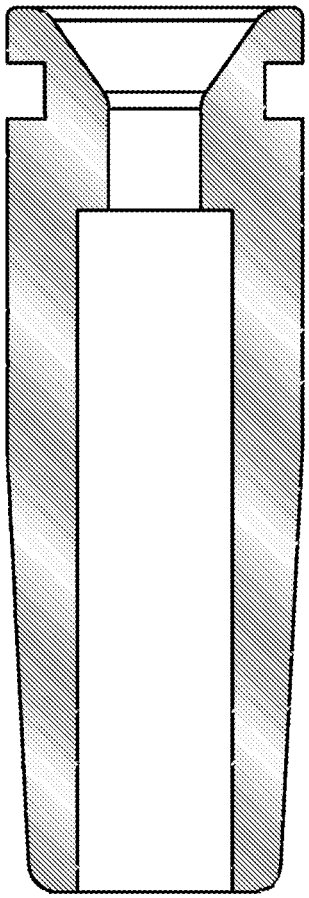

FIGS. 11A and 11B illustrate an elevated front side and cross section view of said rope nozzle 514.

Like said top housing 406, said one or more lower aperture extensions 1026 can extend from a substantially circular portion (a bottom portion top surface 1030) and enable lower fastener apertures 1006 to substantially surround said side wall 1014.

In one embodiment, lower rod holder extension 1058 extends forward and provides surface area to clamp on said rod 110.

In one embodiment, one or more rope side clearances 1054 can allow said surf rope 112 to pass into said bottom housing 408 without damage and to wrap around said pulley 632.

Figure 12A:
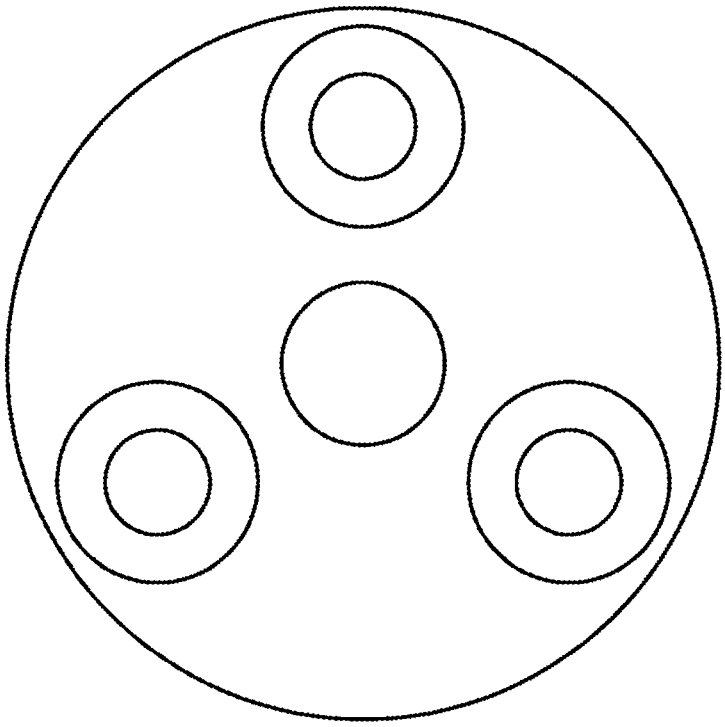
FIGS. 12A, and 12B illustrate an elevated top and side view of a rider plate 656.
Figure 12B:
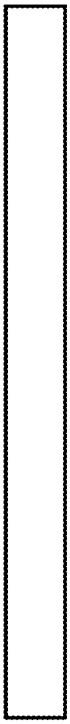
Figure 13A:
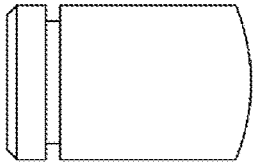
FIGS. 13A, 13B, 13C and 13D illustrate four views of a retaining pint.
Figure 13B:
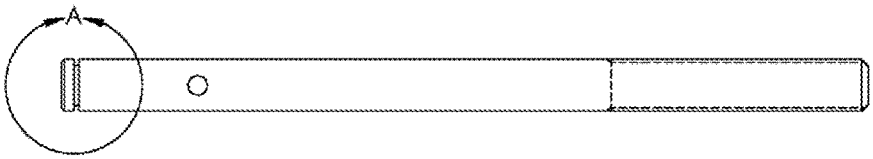
Figure 13C:
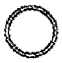
Figure 13D:
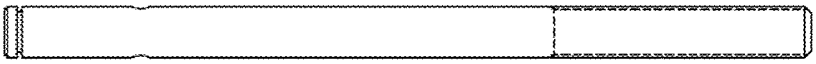

FIGS. 12A, and 12B illustrate an elevated top and side view of said rider plate 656.

FIGS. 13A, 13B, 13C and 13D illustrate four views of a retaining pint.

Figure 14A:
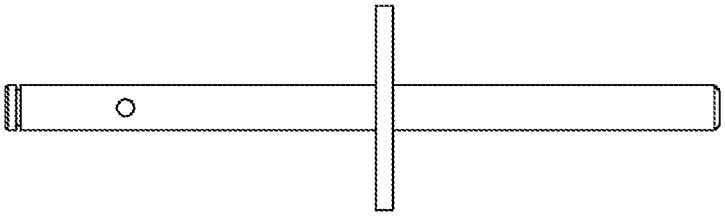
FIGS. 14A, 14B, and 14C illustrate four views of a pivot rod 652.
Figure 14B:
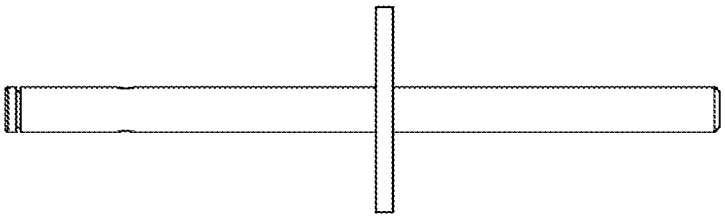
Figure 14C:
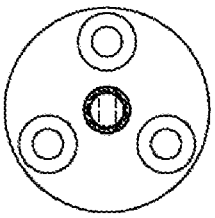

FIGS. 14A, 14B, and 14C illustrate four views of said pivot rod 652.

Said pivot rod 652 can comprise a divider 1410, a spring slot 1412 and a one or more apertures 1414.

The invention claimed is:

1. A reel system for managing a surf rope on a boat, wherein:

said reel system comprises a retraction assembly, a rod and said surf rope;

said boat comprises a cross bar, a stern, a port side, one or more sides, a starboard side, and a tower having a tower height;

said surf rope comprises a first end and a second end;

said reel system comprises a system for positioning and managing said surf rope for a surfer;

said reel system is configured to manage said surf rope by retracting and positioning said surf rope at one or more default rope positions when not in use and otherwise selectively allow said surf rope to rotate back for surfing and skiing purposes;

said one or more default rope positions comprise at least a first default rope position;

said reel system rotates a second end and said handle portion along with said rod along a rotary path at a rotation radius;

when said surfer releases said surf rope, said reel system is configured to rotate to said one or more default rope positions;

a length of said rod is long enough to clear of a rear passenger area;

said rear passenger area comprises portions of said boat between said tower and said stern;

said reel system, therefore, is configured to selectively hold said surf rope out of harm's way for a passenger;

a mounting assembly comprises a mounting plate and a swivel base, and a rider plate;

a top housing cavity and a lower housing cavity are configured to hold portions of a spring, and a pulley;

said spring applies a retraction force to pull said surf rope around said pulley;

said spring is configured to default to pulling said surf rope back into said retraction assembly;

portions of said surf rope is configured to selectively wrap around said pulley in a spool cradle; and said rod comprises a channel comprising a hollow channel between a first end and said second end, and a length.

2. The reel system of claim 1, wherein:

said boat comprises a ski or wake surfing boat.

3. The reel system of claim 1, wherein:

said boat comprises said rear passenger area for said passenger; and a distance back comprises a distance from said stern to a surf position.

4. The reel system of claim 1, wherein:

said retraction assembly comprises a spring;

said spring applies a retraction force to pull said surf rope around said pulley; and said retraction force comprises six to ten pounds of spring force.

5. The reel system of claim 1, wherein:

said retraction assembly comprises a spring;

said spring applies a retraction force to pull said surf rope around said pulley; and said retraction force comprises eight pounds of force.

6. The reel system of claim 1, wherein:

said retraction assembly comprises a first bumper and a second bumper, a front portion, a top housing and a bottom housing; and said first bumper is configured to prevent said reel system from rotating beyond a point along a direction of travel of said boat and said second bumper is configured hold said handle portion over said one or more default rope positions when not in use by said surfer.

7. The reel system of claim 1, wherein:

said length of said rod is long enough to clear of said rear passenger area;

said rear passenger area comprises portions of said boat between said tower and said stern; and said reel system, therefore, is configured to selectively hold said surf rope out of harm's way for said passenger.

8. The reel system of claim 1, wherein:

said retraction assembly comprises said mounting assembly;

said mounting assembly comprises said mounting plate, said swivel base, and a plurality of mounting fasteners; and said mounting plate and said swivel base is configured to squeeze around said cross bar to hold said reel system to said tower.

9. The reel system of claim 1, wherein:

said rod comprises said channel and said length, said channel comprises a hollow channel between said first end and said second end.

10. The reel system of claim 8, wherein:

said retraction assembly is configured to further comprise a rope nozzle, a vertical axis;

said rope nozzle is configured to extend out from said vertical axis and provide a passage from within said retraction assembly for said surf rope to slide in and out without snagging said surf rope; and said rope nozzle comprises a smooth machined part with a conical shape and a hollow central aperture.

11. The reel system of claim 8, wherein:

said retraction assembly comprises an upper bushing, said top housing, a spring, a dampener, said pulley, said bottom housing, and said mounting assembly, a lower bushing, a pivot rod, a plurality of housing fasteners.

12. The reel system of claim 11, wherein:

said mounting assembly comprises said mounting plate and said swivel base, and said rider plate;

said top housing and said bottom housing comprises said top housing cavity and said lower housing cavity;

said plurality of housing fasteners is configured to hold said top housing and said bottom housing together;

said top housing cavity and said lower housing cavity are configured to hold portions of said spring, said pulley, said upper bushing, said dampener, said lower bushing and said pivot rod; and portions of said retraction assembly comprises a central aperture to accommodate said pivot rod, as illustrated.

13. The reel system of claim 12, wherein:

said spring is configured to pull said surf rope back into said retraction assembly by default;

said spring is configured to rotate said handle portion from said surf position to said first default rope position;

said spring applies a retraction force to pull said surf rope around said pulley;

said dampener is configured to slow said retraction force between said retraction assembly, said pulley and said pivot rod to a desired force; and said retraction assembly is configured to retract and reset to said first default rope position without danger to users of said reel system.

14. The reel system of claim 13, wherein:

a portion of said lower housing cavity is configured to mount to a portion of said rider plate;

a second lower bushing is configured to slide through said pivot rod;

said swivel base comprises a rotary slot to limit movement of said rod; and said mounting assembly is configured to further comprise a set screw configured to slide through a portion of said rotary slot and into a portion of said rider plate.

15. The reel system of claim 8, wherein:

one or more washers and nuts are configured to fit on an upper end of said pivot rod;

a portion of said pivot rod slides through a portion of said dampener, and one or more dampener mounts are attached to a portion of said retraction assembly to slow relative movement between said rod and said pivot rod; and a dampener housing cavity is provided to hold portions of said dampener within said top housing cavity.

16. The reel system of claim 8, wherein:

portions of said surf rope is configured to selectively wrap around said pulley in said spool cradle.

17. A reel system for managing a surf rope on a boat, wherein:

said reel system comprises a retraction assembly, a rod and said surf rope;

said boat comprises a cross bar, a stern, a port side, one or more sides, a starboard side, and a tower having a tower height;

said surf rope comprises a first end and a second end;

said reel system comprises a system for positioning and managing said surf rope for a surfer;

said reel system is configured to manage said surf rope by retracting and positioning said surf rope at one or more default rope positions when not in use and otherwise selectively allow said surf rope to rotate back for surfing and skiing purposes;

said one or more default rope positions comprise at least a first default rope position;

said reel system rotates a second end and said handle portion along with said rod along a rotary path at a rotation radius; and when said surfer releases said surf rope, said reel system is configured to rotate to said one or more default rope positions.

* * * * *